US005518082A

United States Patent [19]

Liao

[11] Patent Number: 5,518,082

[45] Date of Patent: May 21, 1996

[54] VERSATILE AND STABLE FIVE-LEGGED SAWHORSE

[76] Inventor: Ming K. Liao, 119-123 North Ave., Owego, N.Y. 13827

[21] Appl. No.: 345,992

[22] Filed: Nov. 28, 1994

[51] Int. Cl.[6] ..... B27B 21/00

[52] U.S. Cl. ..... 182/181; 182/151; 248/162

[58] Field of Search ..... 182/181, 274, 182/151; 248/165, 188.1

[56] References Cited

U.S. PATENT DOCUMENTS

| | | | |
|---|---|---|---|
| 1,039,134 | 9/1912 | Jenkins | 248/165 X |
| 1,738,276 | 12/1929 | Barney | 248/165 |
| 4,433,753 | 2/1984 | Watson | 182/151 |
| 4,790,411 | 12/1988 | Ottoson . | |
| 4,819,762 | 4/1989 | Osborne, Sr. . | |
| 4,951,782 | 8/1990 | Hanson . | |
| 5,170,861 | 12/1992 | Turner . | |
| 5,305,850 | 4/1994 | McQuiston . | |
| 5,335,753 | 8/1994 | Campbell | 182/151 X |

*Primary Examiner*—Alvin C. Chin-Shue
*Attorney, Agent, or Firm*—Barnard, Brown & Michaels

[57] ABSTRACT

A new kind of saw horse comprising two major assemblies that separate into two flat pieces for easy storage and handling. Each assembly has two outside legs which meet an upper beam at a slight angle to the vertical. A vertical center support leg on one of the two assemblies gives additional weight-bearing capacity. Each assembly has an extra lower tie beam that runs horizontally, tying the legs together. The two major assemblies are arranged in a cross format in which each major assembly with its two or three legs forms a ninety-degree angle (right angle) with the other assembly. This arrangement allows the Invention to give a higher degree of safety than the conventional horse, as well improved support for heavy objects.

7 Claims, 3 Drawing Sheets

VERSATILE AND STABLE FIVE-LEGGED SAWHORSE

FIELD OF THE INVENTION

The invention pertains to the field of planar surface supports. More particularly, the invention pertains to sawhorses or the like.

BACKGROUND OF THE INVENTION

The Invention is a new generation of the modem saw horse. To better describe the Invention, it is necessary to understand the ordinary saw horse. The ordinary saw horse consists of a pair of supports, each having two legs attached to each other at an angle of about 45 degrees. A piece of wood is then run and attached to the top of the pairs of legs, forming a beam supported by two triangular supports.

The problem of the ordinary saw horse is that it is unable to support a high amount of weight. If the ordinary saw horse was subjected to an excess of weight, the legs would give way and the weight would cause the legs to spread apart and collapse. The Invention eliminates this problem of excessive weight through the design of its legs. It provides an even distribution of weight that disregards where the weights are applies.

There are many different kinds of saw horses that differ from the common saw horse. Many are complicated in design and complex in use, have moving parts, or are not safe in design.

Examples of recent U.S. Patents Nos. on improved sawhorses of conventional design are Ottoson 4,790,411, Hanson 4,951,782, Turner 5,170,861 and McQuiston 5,305,850.

The "Dream Horse", U.S. Pat. No. 4,819,762, has three legs, unlike the common saw horse. However, the Dream Horse must still be used in pairs to give maximum safety and usage. With the design of its legs, the Dream Horse cannot distribute weight evenly and safely, nor can it support a high amount of weight that the Invention offers.

SUMMARY OF THE INVENTION

The Invention is a new kind of saw horse that differs from the conventional saw horse. The Invention consists of two major assemblies that are able to work separately or in conjunction with each other to perform and aid in work. It is easy to set up and assemble, and to detach and disassemble. Its unique design and construction makes it safer, easier, and stronger than conventional saw horses. These new saw horse can be used in other applications as well as its main purpose.

The Invention consist of two major assemblies that separate into two flat pieces for easy storage and handling. Each assembly has two outside legs which meet an upper beam at a slight angle to the vertical. A vertical center support leg on one of the two assemblies gives additional weight-bearing capacity. Each assembly has an extra lower tie beam that runs horizontally, tying the legs together.

The two major assemblies are arranged in a cross format in which each major assembly with its two or three legs forms a ninety-degree angle (right angle) with the other assembly. This arrangement allows the Invention to give a higher degree of safety than the conventional horse, as well improved support for heavy objects.

Not only is it a saw horse, but due to its unique design, the Invention can be used in many other ways. The Invention, is preferably made from wood, but it can be made in about any size and from any material of preference.

The Invention can be used for other tasks besides the main purpose of a saw horse. For example, the Invention can become a table with just the addition of a board placed on top, and a chair (smaller version) that can be conveniently carried, assembled, and stored.

DESCRIPTION OF THE PREFERRED EMBODIMENT

Figure 1:
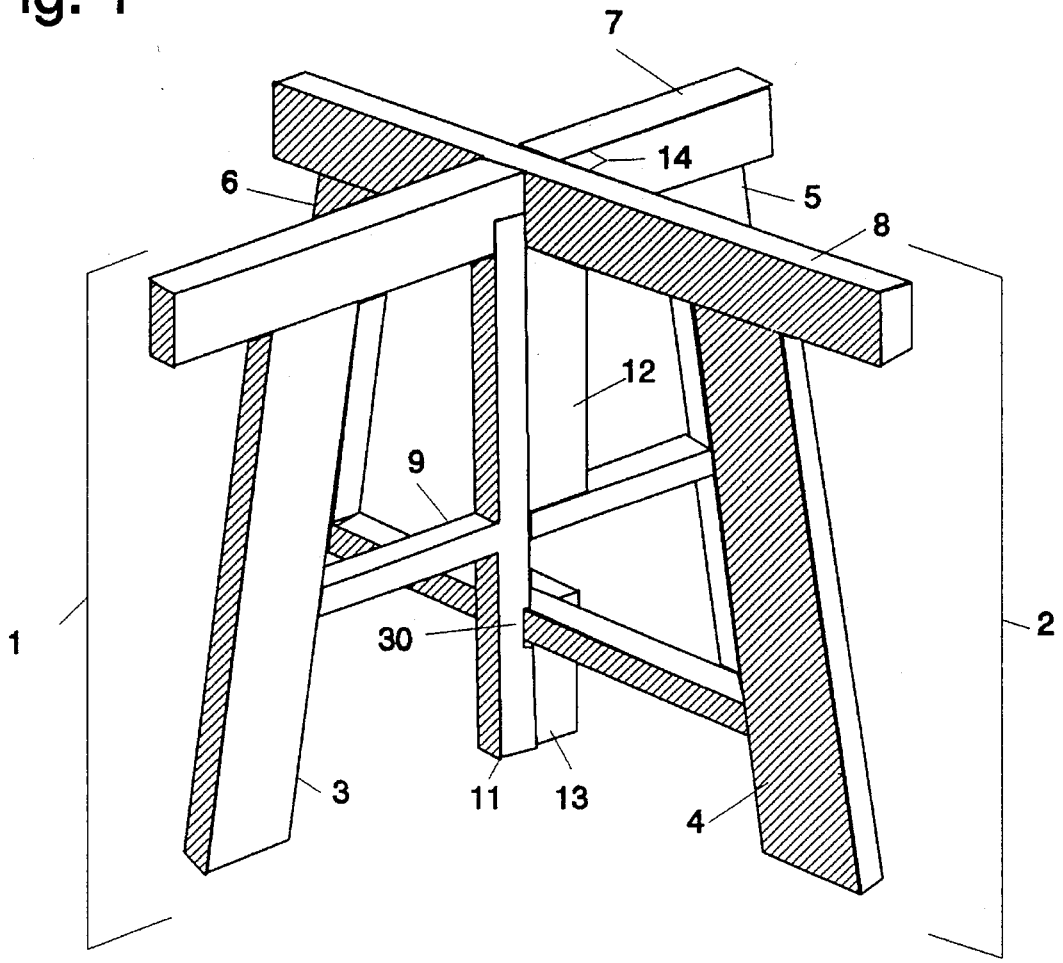
FIG. 1 shows a perspective view of the sawhorse of the invention.
Figure 2:
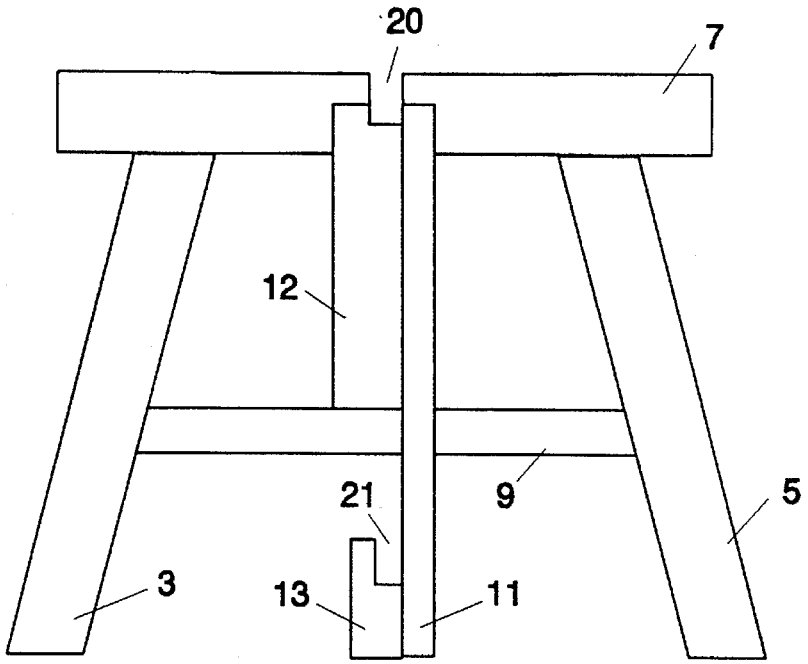
FIG. 2 shows a side view of one of the two major assemblies of the invention.
Figure 3:
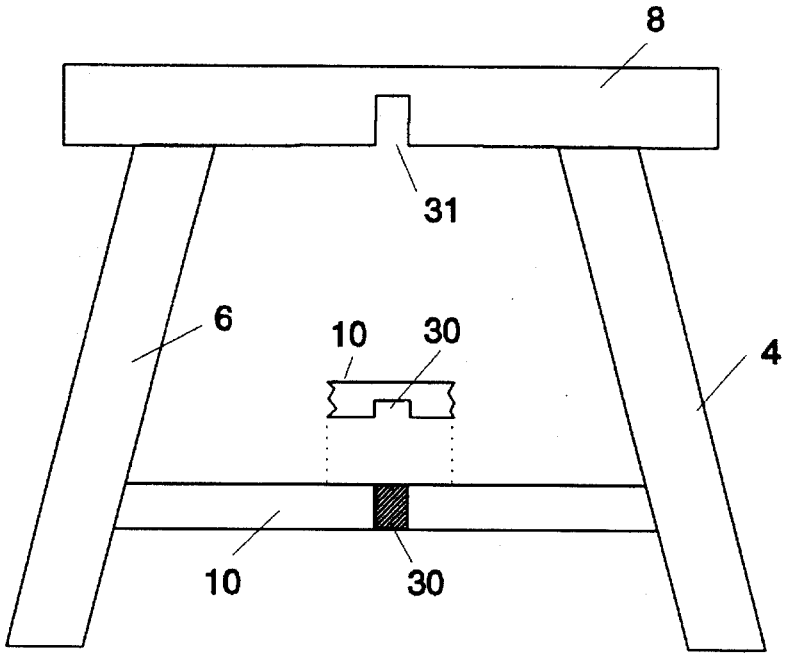
FIG. 3 shows a side view of the second major assembly of the invention.

FIG. 1 shows a perspective view of a sawhorse according to the teachings of the invention, with the two major assemblies (1) and (2) assembled into a single sawhorse. The first (1) and second (2) assemblies are detailed in FIGS. 2 and 3, respectively. In the three figures and the following discussion, identical reference numbers refer to identical elements.

The two major assemblies (1) and (2) each have an upper beam (7) and (8), respectively, on which a surface may be placed. The beams (7) and (8) are supported by two outside legs each: (3) and (5) on the first assembly (1), and (4) and (6) on the second assembly (2). The outside legs are attached to the beams at or near their ends. Although they may be mounted perpendicular (90°) to the center beam, they preferably diverge at a slight angle (10°–20°) from the vertical (i.e. they meet the center beam at an angle of 70° to 80°) for stability, although this angle is not critical. The center beams (7) (8) are preferably approximately 3 feet feet long, and the legs (3)–(6) are preferably 25 inches long, giving a sawhorse of approximately 29 inches height and 3 feet in width. The preferred material for the beams and legs is 2×4" pine lumber.

The first major assembly (1) also has a third center leg (11), which intersects the beam at approximately the center point, slightly offset to allow the interlocking of the second assembly (2), as will be described below. This third center leg (11) greatly increases the weight-beating capacity of the sawhorse. To further support the weight at the center of the beam while still allowing the interlocking, an upper (12) and lower (13) center leg reinforcement piece may be used. The preferred material for the center leg is 2×2" pine lumber, and 2×4" pine lumber for the reinforcement pieces.

Both assemblies include lower tie beams (9) and (10) in assemblies (1) and (2), respectively, which tie the outer legs together to prevent spreading under load. If used, the upper center leg reinforcement piece (12) of the first assembly (1) runs from the upper beam (7) to the lower tie beam (9).

The interlocking of assemblies (1) and (2) is made possible by notches (20), (31), (30), and (21) in the horizontal components (7), (8), and (10), and lower center leg reinforcement piece (13), respectively. Specifically, the upper beam (7) of the first assembly (1) is notched (20) at its center upper surface, and the upper beam (8) of the second assembly (2) is notched (31) at its lower surface, so as to interlock with the two beams (7) and (8) meeting at a 90° angle (14) with their upper surfaces co-planar. Similarly, lower tie beam (10) is notched (30) in its side to fit around center support leg (11), and lower center leg reinforcement piece (13) is notched (21) at its upper end to allow lower tie beam (10) to engage it at a 90° angle. When the two assemblies (1) and (2) are assembled into a sawhorse, the upper surfaces of the beams (7) and (8) are co-planar, and the lower ends of legs (3), (4), (5), (6) and (11) are similarly co-planar, forming a sturdy, stable support.

Figure 4:
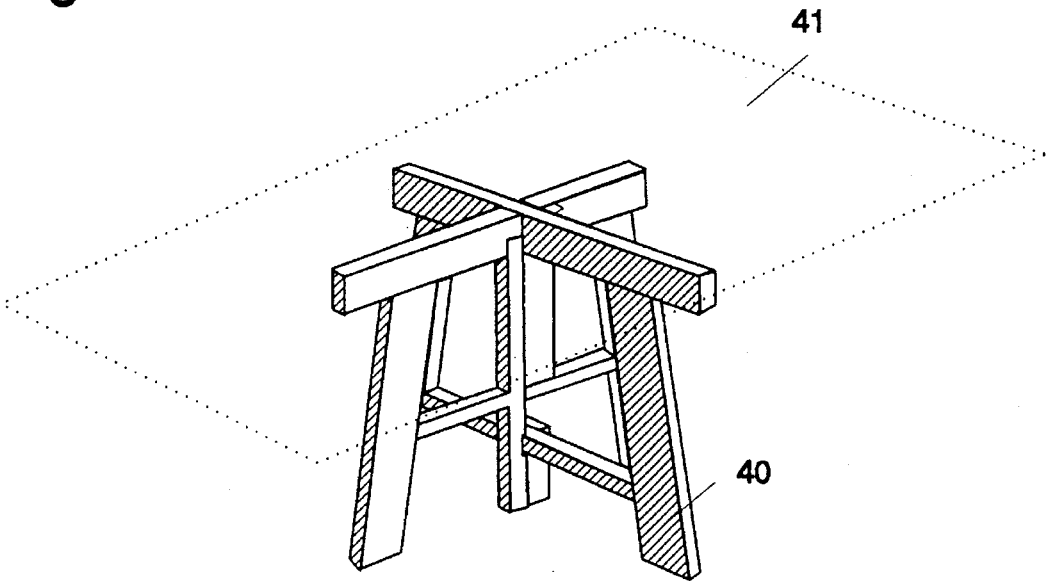
FIG. 4 shows a view of a single sawhorse of the invention in use.
Figure 5:
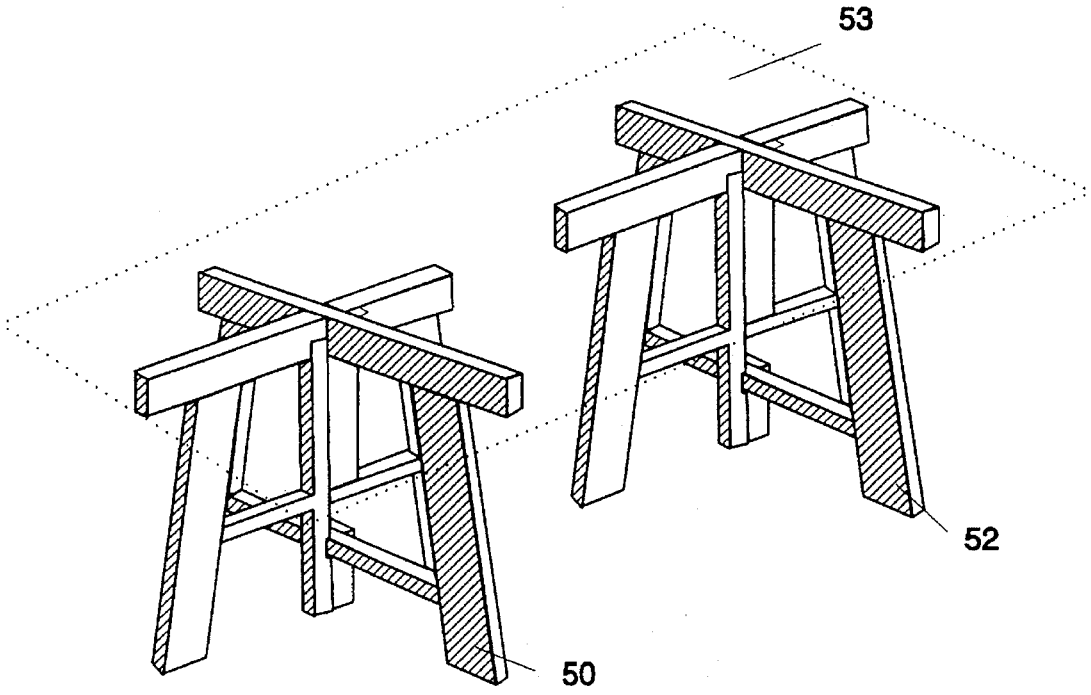
FIG. 5 shows a view of two sawhorses of the invention used to support a table.

As shown in FIG. 4, the sawhorse of the invention then can be used by itself (40) to support a surface (41) such as a sheet of plywood or a table top. If desired, two sawhorses (50) and (52) can be used with larger or rectangular tops (53).

The preferred material for the sawhorse of the invention is wood, although other materials, such as sheet metal formed in box beams, could be used. When made of pine, with lower tie beams (9) and (10) made of 2×2" stock and all other parts made from 2×4" stock, the Invention is light in weight, at approximately 21 pounds. If the two assemblies are separated, they can be easily transported, stored flat, and easily fit against a wall or in a car or truck.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

I claim:

1. An improved sawhorse comprising:

a) a first assembly comprising:

an upper beam having two ends and a length therebetween, with upper and lower surfaces, the upper surface being provided with a notch at the center thereof;

two outer legs, each having upper and lower ends and a length therebetween, the upper ends of the outer legs being attached at an angle of 90° or less to the lower surface of the two ends of the upper beam;

a center support leg having an upper and lower end and a length therebetween, the upper end being attached perpendicularly to the center of the upper beam;

a lower tie beam having two ends attached to the two outer legs and a center attached to the center support leg, the points of attachment of the lower tie beam to the outer legs and the center support leg being below the center thereof;

the lengths of the two outer legs and the length of the center support leg being chosen such that the lower ends of the two outer legs and the center support leg are co-planar when the two outer legs and the center support leg are attached to the upper beam;

b) a second assembly comprising:

an upper beam having two ends and a length therebetween, with upper and lower surfaces, the lower surface being provided with a notch at the center thereof;

two outer legs, each having upper and lower ends and a length therebetween, the upper ends of the outer legs being attached at an angle of 90° or less to the lower surface of the two ends of the upper beam;

a lower tie beam having two ends attached to the two outer legs, the points of attachment of the lower tie beam to the outer legs being below the center thereof;

the lengths of the two outer legs being equal to the lengths of the two outer legs of the first assembly;

the notch in the upper surface of the upper beam of the first assembly and the notch in the lower surface of the upper beam of the second assembly being dimensioned such that when the notch in the upper surface of the upper beam of the first assembly and the notch in the lower surface of the upper beam of the second assembly are fitted into each other, the upper surface of the upper beam of the first assembly and the upper surface of the upper beam of the second assembly are co-planar and the upper beam of the first assembly and the upper beam of the second assembly meet at right angles.

2. The improved sawhorse of claim 1, in which the outer legs of the first and second assemblies meet the upper beams of the first and second assemblies at an angle in the range of 70° to 80°.

3. The improved sawhorse of claim 1, in which the first assembly further comprises an upper reinforcement piece located between the lower surface of the upper beam and the lower tie beam, underneath the notch at the center of the upper surface and adjacent to the center support leg.

4. The improved sawhorse of claim 1, in which the first assembly further comprises a lower reinforcement piece having upper and lower ends, the lower reinforcement piece being attached to the center support leg such that the lower end of the center support leg and the lower end of the lower reinforcing piece are co-planar.

5. The improved sawhorse of claim 4, in which the lower reinforcement piece has a notch in its upper end such that the lower tie beam of the second assembly rests in the notch at the upper end of the lower reinforcing piece.

6. The improved sawhorse of claim 1, in which the lower tie beam of the second assembly has a notch in one side of the center thereof, located such that the notch interlocks with the center support leg of the first assembly.

7. The improved sawhorse of claim 1, further comprising a flat planar surface resting upon the upper surfaces of the upper beams of the first and second assemblies.

* * * * *